US006219946B1

(12) United States Patent
Soczka

(10) Patent No.: US 6,219,946 B1
(45) Date of Patent: Apr. 24, 2001

(54) POWER SHOVEL WITH DIPPER DOOR SNUBBER AND/OR CLOSURE ASSEMBLY

(75) Inventor: Carl A. Soczka, Greenfield, WI (US)

(73) Assignee: Harnischfeger Technologies, Inc, Wilmington, DE (US)

( * ) Notice: Subject to any disclaimer, the term of this patent is extended or adjusted under 35 U.S.C. 154(b) by 0 days.

(21) Appl. No.: 09/376,805

(22) Filed: Aug. 18, 1999

(51) Int. Cl.[7] ..... E02F 3/407

(52) U.S. Cl. ..... 37/445; 37/444; 414/726; 188/312

(58) Field of Search ..... 37/445, 444, 398, 37/442; 414/726; 60/469; 188/312, 317; 267/217, 136, 137; 16/374, 375

(56) References Cited

U.S. PATENT DOCUMENTS

| | | | | |
|---|---|---|---|---|
| 3,999,745 | * | 12/1976 | Mahoff | 267/64 R |
| 4,006,832 | * | 2/1977 | Auxer et al. | 214/146 R |
| 4,191,280 | * | 3/1980 | Copperwheat | 188/300 |
| 4,280,600 | * | 7/1981 | Salmon et al. | 188/312 |
| 4,323,283 | * | 4/1982 | Muramoto et al. | 305/10 |
| 4,662,486 | * | 5/1987 | Stenberg | 188/312 |
| 4,921,272 | * | 5/1990 | Ivers | 280/707 |
| 4,981,199 | * | 1/1991 | Tsai | 188/312 |
| 5,289,615 | * | 3/1994 | Banks et al. | 16/366 |
| 5,499,463 | * | 3/1996 | Profio et al. | 37/398 |
| 5,558,190 | * | 9/1996 | Chang | 188/312 |
| 5,613,308 | * | 3/1997 | Little | 37/445 |
| 5,815,960 | * | 10/1998 | Soczka | 37/445 |
| 5,823,306 | * | 10/1998 | De Molina | 188/322.15 |
| 5,839,213 | * | 11/1998 | Abbott et al. | 37/443 |
| 5,911,290 | * | 6/1999 | Steed | 188/282.4 |

* cited by examiner

*Primary Examiner*—Victor Batson
(74) *Attorney, Agent, or Firm*—David R. Price

(57) ABSTRACT

Power shovels include a dipper door which must be held shut to retain a load of material within a dipper and which must be allowed to open to discharge the load of material from the dipper. Such dipper doors are extremely heavy and, as a result, the opening and closing of the dipper doors must be dampened in order to prevent the dipper doors from banging against other components of the power shovels. There is provided a hydraulic assembly which is mounted to a dipper body and a dipper door of a dipper of a power shovel. The hydraulic assembly includes a restricted flow conduit to prevent unrestricted flow of hydraulic fluid between fluid chambers of the hydraulic assembly. Accordingly, as the dipper door opens or closes, as the hydraulic fluid moves from one chamber of the hydraulic assembly to the other, the restricted movement of the fluid causes the dipper door to open or close in a controlled manner thereby dampening the effect of movement of the dipper door. The hydraulic assembly can also include a valve which is adapted to control the flow of hydraulic fluid through a conduit which connects two separate hydraulic chambers of the hydraulic assembly. Thus, if the valve is closed, the dipper door cannot move because the hydraulic fluid is not able to move from one chamber to the other. Further, if the valve is opened, the dipper door can move because the hydraulic fluid is able to move from one chamber to the other.

12 Claims, 4 Drawing Sheets

POWER SHOVEL WITH DIPPER DOOR SNUBBER AND/OR CLOSURE ASSEMBLY

FIELD OF THE INVENTION

The present invention relates to power shovels and, more particularly, to power shovels having a dipper adapted for excavating earthen material. Specifically, the present invention relates to snubbers and latches for dipper doors.

BACKGROUND OF THE INVENTION

There are many known earth moving apparatuses or the like. Typical prior art earth moving equipment or excavators use a bucket or dipper assembly on the end of a movable arm which is used to scoop earthen material from horizontal or vertical faces. The bucket or dipper is normally provided with sharp teeth to provide a digging action against the surface being worked and further includes a cavity for collecting the material so removed. Once the earthen material is received within the dipper, the arm is typically moved to another location for transfer of the material. The material is usually discharged into a dump truck, onto a conveyor, or merely onto some other pile.

Many such power shovels include a heavy door which is pivotally mounted on a lower end of the dipper. A conventional mechanical latch mechanism secures the door in its closed position and, when released, allows the door to open. Conventional latch mechanisms typically include a trip wire or cable assembly which has one end adapted for control by a power shovel operator and another end connected to a moveable latch lever which is generally located beneath the dipper door. The latch lever is typically coupled to a slidable rod or latch bar which selectively engages a latch keeper extending downward from a front wall of the dipper body of the dipper. The dipper door is held closed when the latch bar is in engagement with the latch keeper. The dipper door is caused to open by tripping the trip cable which moves the latch lever which causes the latch bar to slide away from the latch keeper and disengage from the latch keeper, whereby the dipper door will open under its own weight plus the weight of any material contained within the dipper body. Normally, the door is thereafter closed by swinging the dipper in such a direction so as to cause the dipper door to move by inertia towards its closed position until the latch bar reengages the latch keeper as is conventionally known.

As generally known in the art, when the dipper door falls open or slams shut against the dipper body, the impact, if not dampened, can cause damage to the dipper door, dipper body and/or other components of the power shovel. As is commonly understood, devices for dampening the effect of the opening and the closing of a dipper door are typically referred to as snubbers. Many prior snubbers include clutch disk assemblies or brake disk assemblies.

BRIEF SUMMARY OF THE INVENTION

One problem with conventional mechanical latch closure mechanisms is the tendency for such mechanisms to quickly wear out and require replacement in only a short period of time. Each time the slidable latch bar engages the latch keeper or the like, the tip of the slidable latch bar naturally wears down. In many conventional latch mechanisms, the slidable latch bar is only moved about a half inch to about an inch in order to allow the dipper door to open. Thus, only a very small portion, i.e., the tip, of the slidable latch bar comes into contact with the latch keeper. As the tip of the slidable latch bar wears down over time, it becomes possible for the dipper door to prematurely open before the power shovel operator is ready for the dipper door to open. This, as can be appreciated by those skilled in the art, can create an extremely hazardous and unsafe condition if the power shovel is not properly maintained.

Another common problem with the prior mechanical latch closure mechanisms occurs when the excavated material has been discharged from the dipper and the dipper door is inadvertently dragged back across the discharged material as the power shovel operator starts a new digging cycle. Since many of the components of the latch mechanism, in particular, the latch lever, the latch bar and the latch keeper, are located on the bottom side of the dipper door, it is possible for the components of the latch mechanism to be damaged or at least clogged when these components come into contact with the discharged material. Such damage or interference could adversely affect the operation of the latch mechanism thereby preventing the dipper door from properly closing, possibly leading to the premature opening of the dipper door.

One problem with the prior clutch disk or brake disk snubber devices is the constant need to adjust the disks to ensure proper operation of the snubbers. As can be appreciated by those skilled in the art, as the clutch or brake disks wear down by virtue of repeated use, they must be readjusted or realigned in order to obtain the desired dampening effect. Although, when properly adjusted, clutch disk or brake disk snubber assemblies provide adequate dampening for a dipper door, the constant need to readjust these assemblies requires significant manpower, time and expense.

Thus, there exists a need in the art for a latch mechanism which does not require replacement in only a very short amount of time. There is also a need in the art for a snubber which does not require frequent readjustment. The invention provides an apparatus which acts as a closure device for a dipper door and which does not utilize conventional mechanical latch devices. The invention also provides an apparatus which is capable of acting not only as a closure device, but also as a snubber device, thereby providing a simple and inexpensive alternative to prior assemblies. Accordingly, the present invention provides a hydraulic assembly which acts as a closure mechanism and/or a dampening device for a dipper door of a power shovel.

The hydraulic assembly is provided with a hydraulic cylinder and a piston which is movable within the hydraulic cylinder. The piston divides the hydraulic cylinder into a first chamber and a second chamber wherein the volumes of the chambers change as the piston moves back and forth within the hydraulic cylinder. A piston rod is attached to the piston and extends through the hydraulic cylinder. Either the hydraulic cylinder or the piston rod is connected to the dipper body and the other is connected to the dipper door itself.

In one embodiment of the present invention, a restricted flow conduit is provided to connect the first chamber of the hydraulic cylinder with the second chamber of the hydraulic cylinder. By "restricted" it is meant that the conduit is constructed such that when hydraulic fluid flows between the chambers as the dipper door is opening or closing, the hydraulic fluid does not flow too quickly, and the hydraulic assembly thereby dampens or slows down the movement of the dipper door so as to substantially ensure that the dipper door does not bang or slam against the dipper body or other components of the power shovel.

In the preferred embodiment of the present invention a valve controls the hydraulic fluid flow through the conduit from one of the chambers to the other chamber. In this way, when the valve is closed, the hydraulic fluid is prevented from flowing between the chambers so that the dipper door is prevented from moving. When the valve is opened, the hydraulic fluid is allowed to flow between the chambers such that the dipper door is allowed to move. Thus, preferably, the hydraulic assembly is both a snubber device and a closure mechanism.

In a highly preferred embodiment, the power shovel does not include a conventional mechanical latch mechanism, and only includes the hydraulic assembly.

In an alternative embodiment, the conduit is not restricted but has the valve therein, and the hydraulic assembly acts only as a latch mechanism.

Accordingly, a feature of the present invention is to provide a power shovel which includes an apparatus adapted to effectively dampen the opening and closing of a dipper door to prevent damage to the dipper door and/or power shovel which would occur if the dipper door is not dampened.

Another feature of the present invention is to provide a power shovel which includes an apparatus adapted to effectively close a dipper door to prevent undesirable opening of the door thereby eliminating or, at least minimizing, hazardous or unsafe conditions which are virtually inevitable when a dipper door prematurely opens.

A further feature of the present invention is to provide a power shovel which includes an apparatus adapted to act both as a snubber device and a locking mechanism for a dipper door, thereby eliminating the complex assemblies of the prior art which typically include both a snubber assembly and a mechanical latching mechanism.

The apparatus according to the present invention is a simple, inexpensive assembly which is also capable of solving many of the problems attributable to the more complicated, costly designs of the prior art.

Other features and advantages of the invention will become apparent to those skilled in the art upon review of the following detailed description, claims and drawings in which like numerals are used to designate like features.

Figure 1:
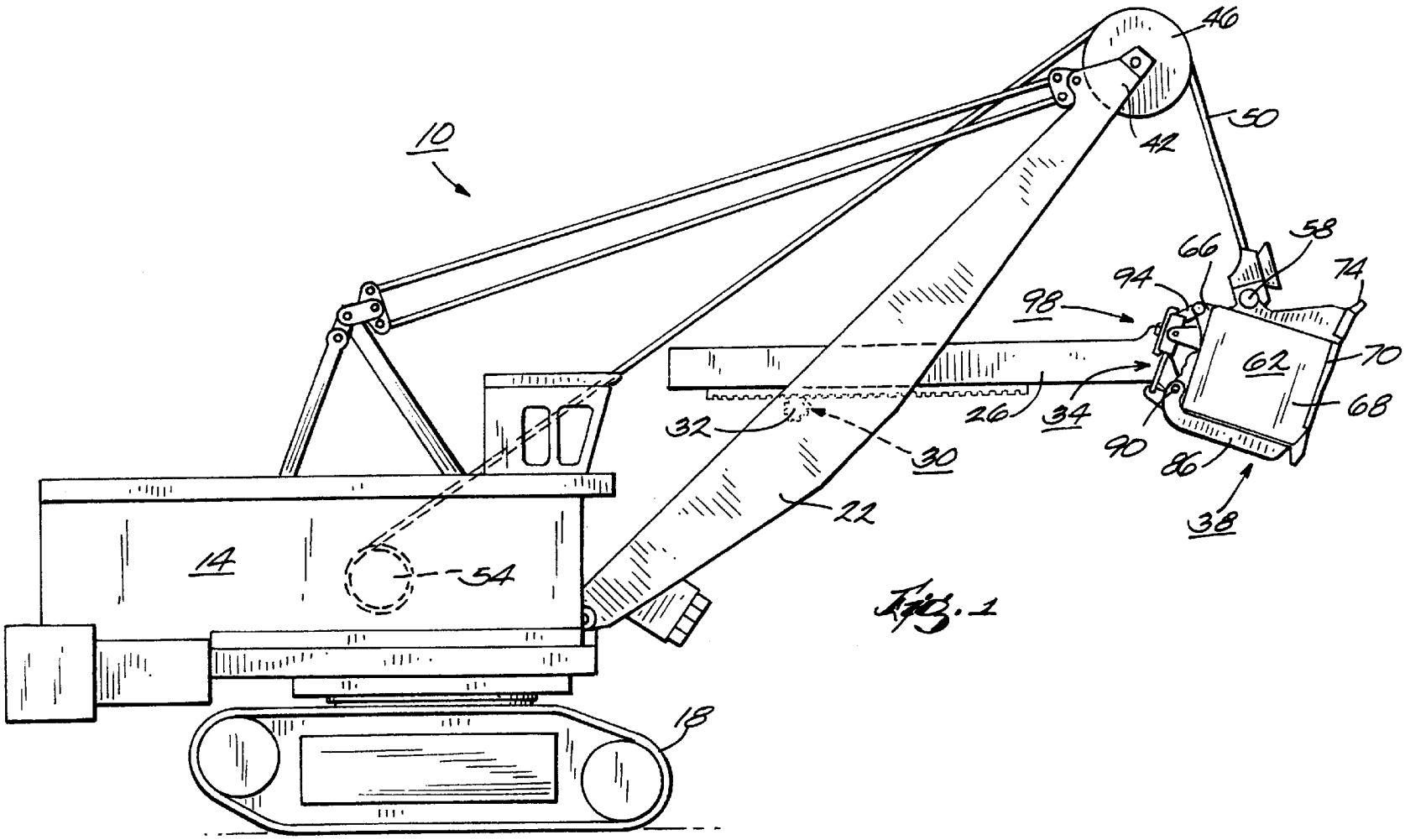
FIG. 1 is a side elevational view of a power shovel embodying the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENTS

Illustrated in FIG. 1 is a power shovel 10 embodying the present invention. It should be understood that the present invention is capable of use in other power shovels known in the art and power shovel 10 is only provided as an example of one such power shovel. The power shovel 10 comprises a frame 14 supported for movement over the ground. Specifically, frame 14 is a revolvable upper frame mounted on a mobile base such as crawler tracks 18. A fixed boom 22 extends upwardly and outwardly from the frame 14. A dipper handle 26 is mounted on the boom 22 for movement about a rack and pinion or crowd drive mechanism 30 for pivotal movement relative to the boom 22 about a generally horizontal dipper handle axis 32, and for translational (non-pivotable) movement relative to the boom 22. The dipper handle 26 has a forward end 34. A dipper 38 is mounted on the forward end 34 of the dipper handle 26 in a manner further described below. An outer end 42 of the boom 22 has thereon a sheave 46, and a hoist cable or rope 50 extends over the sheave 46 from a winch drum 54 mounted on the frame 14 and is connected to the dipper 38 for pivotal movement relative thereto about a horizontal pivot axis 58.

The dipper 38 will be further described with continued reference to FIG. 1 in which the dipper handle 26 is shown in a generally horizontal position. The dipper 38 is generally of a box shape having a main body 62 which includes a back wall 66, opposite side walls 68 extending forwardly from and substantially perpendicular to the back wall 66, and a front wall 70 which is generally parallel to the back wall 66. Digging teeth 74 extend outwardly from an upper end of the front wall 70. The main body or dipper body 62 defines a material receiving opening 78 (FIG. 4) and a material discharging opening 82 (FIG. 5). The dipper 38 further includes a dipper door 86 pivotally connected to the back wall 66 adjacent the lower end thereof about a dipper door axis 90. The dipper door 86 is movable between open and closed positions as will be further described below. The back wall 66 of the dipper 38 is connected to the forward end 34 of the dipper handle 26. The back wall 66 (and thus the dipper 38) is connected to the dipper handle 26 for pivotal movement relative thereto about a generally lower horizontal dipper axis which corresponds to dipper door axis 90. Thus, in the illustrated construction, the lower dipper axis is coaxial with the axis 90 of pivotal movement of the door 86 relative to the dipper 38. These axes need not, however, be coaxial.

Still referring to FIG. 1, the tooth cutting angle of the dipper 38 is controlled by a pair of attenuators 94 (only one is shown) connected to the dipper 38 and the dipper handle 26. Such attenuators 94 are typically mounted on each side of the dipper 38 and are preferably variable pitch braces or shock attenuators as described in U.S. Pat. No. 5,499,463 which is hereby incorporated herein by reference. The dipper 38 pivots relative to the dipper handle 26 and about the lower dipper axis 90 coincident with extension and contraction of a spring (not shown) in the attenuators 94. It should be understood that the dipper 38 can be connected to the dipper handle 26 in any number of ways known to those skilled in the art and still benefit from the use of the present invention.

The power shovel 10 also comprises (see also FIG. 2) a hydraulic assembly 98. While only a single hydraulic assembly 98 is shown in the drawings, a second hydraulic assembly may be spaced apart from the first hydraulic assembly 98 on the opposite side of the dipper handle 26.

Figure 2:
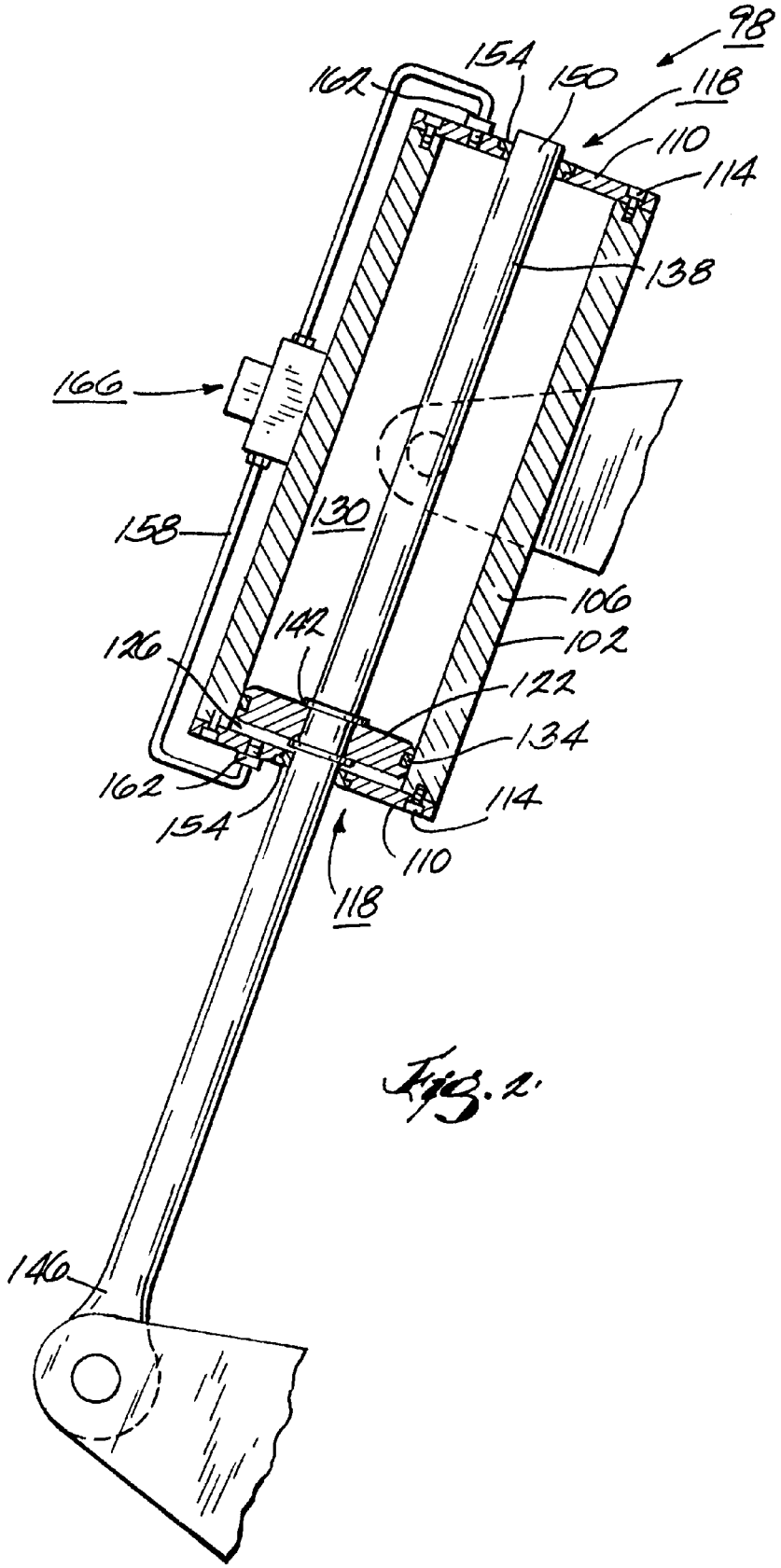
FIG. 2 is a cross-sectional view of the hydraulic assembly.

Referring to FIG. 2, the hydraulic assembly 98 includes a hydraulic cylinder 102 mounted on the dipper body 62. Any suitable mounting can be employed. Typically, hydraulic cylinder 102 includes a main body 106 and a pair of opposing end walls 110 conventionally attached to the main body 106 with screws 114. The end walls 110 include respective holes 118.

The hydraulic assembly 98 also includes a piston 122 which is movable within the hydraulic cylinder 102 and which divides the hydraulic cylinder into a first chamber 126 and a second chamber 130. As can be appreciated, as the piston 122 moves within the hydraulic cylinder 102, the volumes within the chambers 126 and 130 vary accordingly. As can also be appreciated by those skilled in the art, located on either side of piston 122 is hydraulic fluid. A piston seal 134 is provided to move with the piston 122 between the piston 122 and inside wall of the hydraulic cylinder 102 to prevent or inhibit passage of the hydraulic fluid from one chamber 126 to the other chamber 130, or vice versa, between the piston 122 and inside wall of the hydraulic cylinder 102.

The hydraulic assembly 98 further includes a piston rod 138 attached to the piston 122. Generally, the piston rod 138 travels through a centrally located bore in the piston 122 and is attached to the piston 122 via retainer rings 142 or the like. The piston rod 138 extends through the hydraulic cylinder 102 through holes 118 such that one end 146 of piston rod 138 extends outward of one end wall 110 of the hydraulic cylinder 102 and is pivotally connected to the dipper door 86 in a suitable manner. The other end 150 of piston rod 138 extends outward of the other end wall 110 of the hydraulic cylinder 102. A pair of piston rod seals 154 prevent or at least minimize leakage of the hydraulic fluid from the chambers 126 and 130 between the piston rod 138 and end walls 110.

Figure 4:
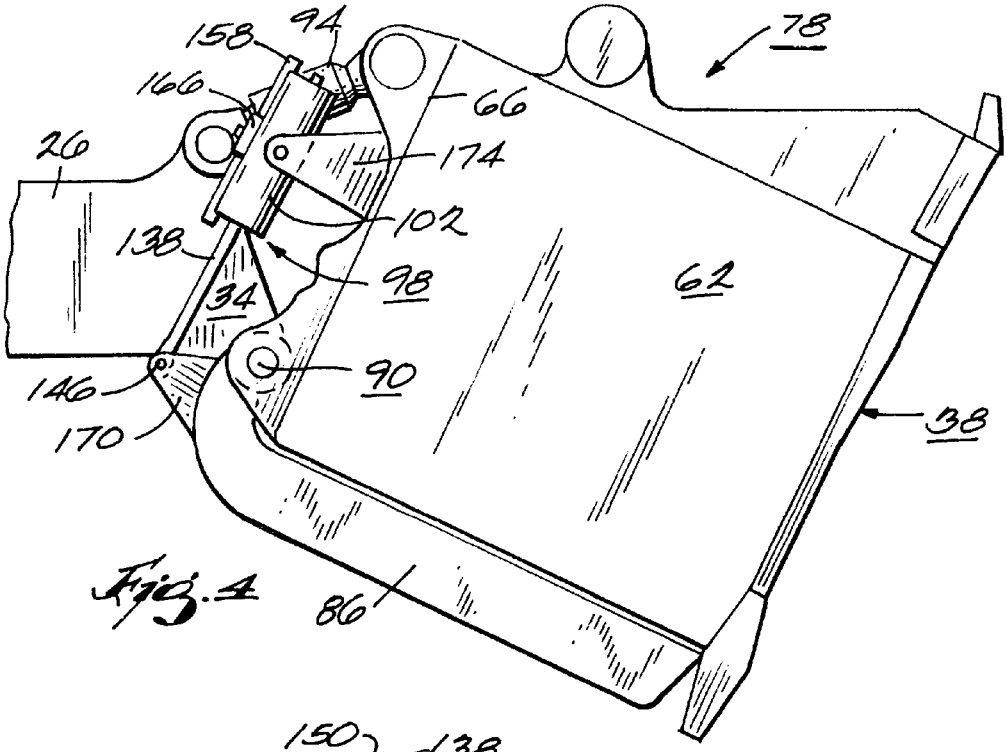
FIG. 4 is an enlarged portion of FIG. I showing the hydraulic assembly with the dipper door closed.
Figure 5:
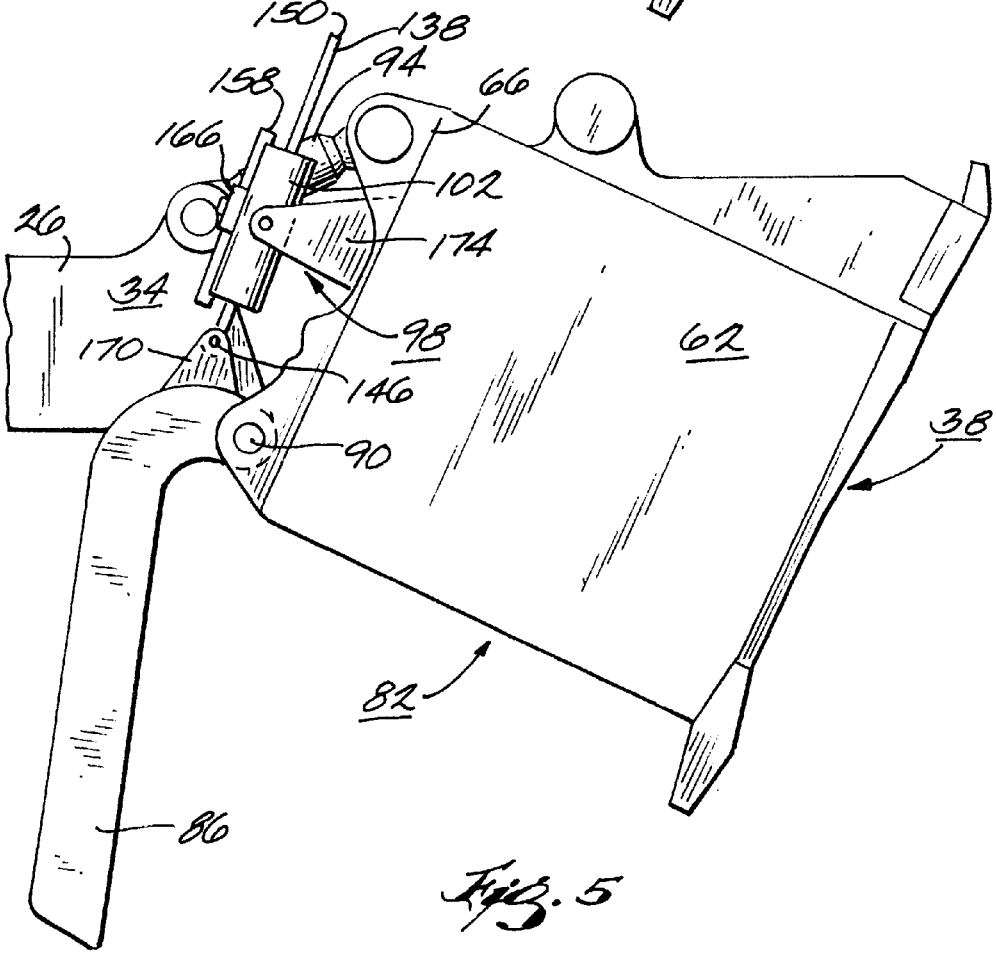
FIG. 5 is a view similar to FIG. 4 wherein the dipper door is open.

While in the illustrated construction, as best shown in FIGS. 4 and 5, the piston rod 138 is connected to the dipper door 86 and the hydraulic cylinder 98 is connected to the dipper body 62, it should be understood that the piston rod 138 could be connected to the dipper body 62 and the hydraulic cylinder 102 could be connected to the dipper door 86. As shown, end 146 of piston rod 138 is pivotally connected to a trunnion mount 170 located on a back portion of the dipper door 86 near the dipper door axis 90. The hydraulic cylinder 102 is securely mounted to the back wall 66 of the dipper body 62 with bracket 174. As shown, when end 146 of piston rod 138 extends farther out from the hydraulic cylinder 102 as compared to end 150 of piston rod 138, the connection between the end 146 of piston rod 138 and the trunnion mount 170 causes the dipper door 86 to be closed according to the principles of the present invention. However, when end 150 of piston rod 138 extends farther out from the hydraulic cylinder 102 as compared to end 146 of piston rod 138 because the piston 122 (and therefore, the piston rod 138) moves in an opposite direction within the hydraulic cylinder 102, the connection between the end 146 of piston rod 138 and the trunnion mount 170 causes the dipper door 86 to move. While the end 150 of the piston rod preferably extends through the wall 110 for support, this is not always necessary.

Referring back again to FIG. 2, the hydraulic assembly 98 includes a restricted flow conduit 158 which connects the first chamber 126 with the second chamber 130. Preferably, as shown, the conduit 158 is external of the hydraulic cylinder 102. However, the conduit 158 could extend through the wall 106 of the hydraulic cylinder 102. Opposite ends 162 of conduit 158 are respectively attached to the end walls 110 of the hydraulic cylinder 102 in any number of suitable ways so long as the first chamber 126 is capable of communication with the second chamber 130 via conduit 158.

A valve 166 controls the hydraulic fluid flow through the conduit 158. The valve 166 can be a conventional on/off valve generally known to those skilled in the art and readily available from numerous commercial sources, but may be of any type of valve suitable for use according to the principles of the present invention. Preferably, the valve 166 is a solenoid valve which is controlled by way of a remote switch (not shown) operated by the power shovel operator. Such valves are commonly known to those skilled in the art and are also readily available from numerous commercial sources.

Figure 3:
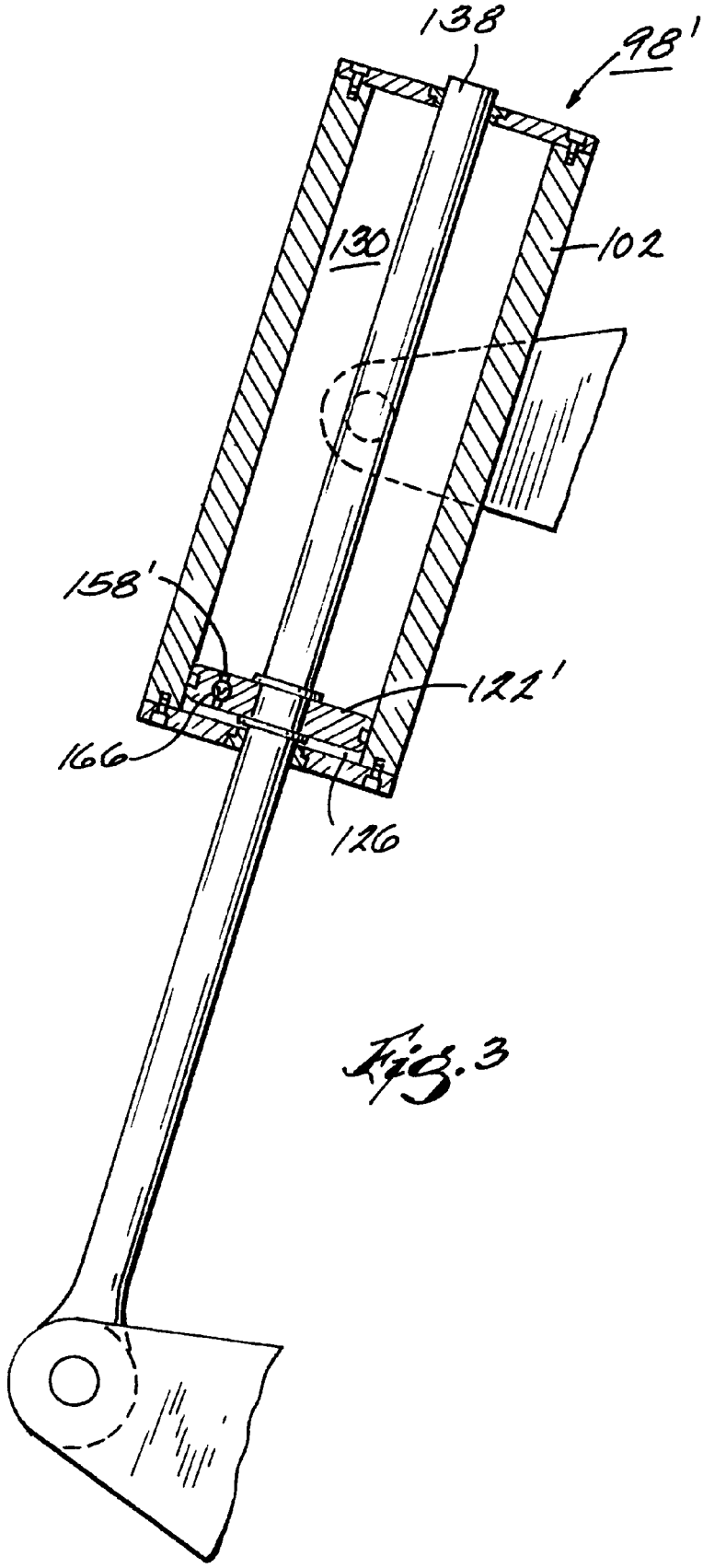
FIG. 3 is a cross-sectional view of an alternative hydraulic assembly.

FIG. 3 shows an alternative hydraulic assembly 98'. In this embodiment, the conduit 158' extends through the piston 122' to connect the first chamber 126 to the second chamber 130. In all other aspects, the hydraulic assembly 98' of FIG. 3 is practically the same as the hydraulic assembly 98 of FIG. 2.

The operation of the hydraulic assembly will now be further described with particular reference to FIGS. 4 and 5, it being understood that the hydraulic assembly 98' of FIG. 3 and equivalent hydraulic assemblies can replace the hydraulic assembly 98 as shown in FIGS. 4 and 5. As generally known, a digging or excavating cycle of the power shovel 10 begins with the dipper 38 in a tucked position and the dipper door 86 in a closed position. In the closed position, the dipper door 86 closes the material discharge opening 82 (FIG. 5) as shown, for example, in FIG. 4. While the door 86 is closed, the valve 166 is closed to prevent the flow of hydraulic fluid between chambers 126 and 130 so that the hydraulic assembly 98 prevents the dipper door 86 from pivoting about the dipper door axis 90.

As the digging cycle continues, the dipper handle 26 is pivoted counterclockwise so that the dipper 38 contacts the ground or bank of material being excavated. As the dipper handle 26 is pivoted further counterclockwise, the dipper handle 26 is extended (crowded) as necessary for the dipper 38 to excavate more of the load as ground material passes into the dipper body 62 through the material receiving opening 78 (FIG. 4). Finally, the dipper handle 26 reaches the horizontal position as shown in FIG. 1. Once the dipper 38 has collected the load of material and has been moved to a proper location, the valve 166 is opened so that the hydraulic fluid is allowed to flow between the chambers 126 and 130, thereby allowing the dipper door to open, whereby the load of material is discharged through the material discharging opening 82.

After the material has been discharged, the dipper 38 is swung downward which causes the dipper door 86 to move by inertia towards its closed position. As gravity closes the dipper door 86, the movement of the door 86 causes the hydraulic assembly 98 to contract, which causes the hydraulic fluid in the chamber 126 to shift back or flow back to the chamber 130 via conduit 158. Once the dipper door is closed, the valve 166 is closed to prevent the dipper door 86 from opening until such time as the power shovel operator chooses to open the door 86 by opening the valve 166.

Throughout the digging cycle, when the dipper door 86 is allowed to pivot about the dipper door axis 90 thereby opening or closing, the restricted flow conduit 158 prevents the hydraulic fluid from transferring too quickly between the chambers 126 and 130. Thus, the hydraulic assembly of the present invention effectively dampens the opening and closing of the dipper door.

Variations and modifications of the foregoing are within the scope of the present invention. For example, although the hydraulic assembly according to the present invention eliminates the need for the mechanical latch mechanisms of the prior art, it is envisioned that the hydraulic assembly of the present invention may act only as a snubber device as described herein whereby conventional latch mechanisms may be employed to latch a dipper door of a power shovel. Furthermore, the hydraulic assembly of the present invention may act only as a closure device as described herein whereby other known snubber devices may be employed to dampen the effect of opening and closing a dipper door of a power shovel. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A power shovel comprising:

a frame;

a dipper handle mounted on said frame for pivotal movement relative thereto about a dipper handle axis;

a dipper connected to said handle for movement therewith, said dipper having a dipper body defining a material receiving opening and a material discharging opening, said dipper further having a dipper door mounted on said dipper body for pivotal movement relative thereto about a dipper door axis for opening and closing said discharge opening; and a hydraulic assembly including a hydraulic cylinder, a piston which is movable within said hydraulic cylinder and which divides said hydraulic cylinder into a first variable volume chamber and a second variable volume chamber, a piston rod attached to said piston, one of said hydraulic cylinder and said piston rod being connected to said dipper body and the other of said hydraulic cylinder and said piston rod being connected to said dipper door, a conduit connecting said first chamber to said second chamber, and a valve for controlling hydraulic fluid flow through said conduit from one of said chambers to the other of said chambers such that when said valve is closed, the hydraulic fluid is substantially prevented from flowing between said chambers so that said dipper door is substantially prevented from pivoting about said dipper door axis, and such that when said valve is opened, the hydraulic fluid is allowed to flow between said chambers such that said dipper door is allowed to pivot about said dipper door axis.

2. A power shovel according to claim 1, wherein said piston rod is connected to said dipper door.

3. A power shovel according to claim 1, wherein said conduit is external of said hydraulic cylinder.

4. A power shovel according to claim 1, wherein said conduit extends through said piston.

5. A power shovel according to claim 1, wherein said power shovel does not have a latch mechanism other than said hydraulic assembly.

6. A power shovel according to claim 1, wherein said valve is a solenoid valve.

7. A power shovel according to claim 1, wherein said dipper handle axis is generally horizontal, and wherein said dipper body is mounted on said dipper handle for pivotal movement relative thereto about a generally horizontal dipper axis.

8. A power shovel comprising:

a frame;

a dipper handle mounted on said frame for pivotal movement relative thereto about a generally horizontal dipper handle axis;

a dipper connected to said handle for movement therewith, said dipper having a dipper body defining a material receiving opening and a material discharging opening, said dipper further having a dipper door mounted on said dipper body for pivotal movement relative thereto about a dipper door axis for opening and closing said discharge opening; and a hydraulic assembly including a hydraulic cylinder, a piston which is movable within said hydraulic cylinder and which divides said hydraulic cylinder into a first variable volume chamber and a second variable volume chamber, a piston rod attached to said piston, one of said hydraulic cylinder and said piston rod being connected to said dipper body and the other of said hydraulic cylinder and said piston rod being connected to said dipper door, a restricted flow conduit connecting said first chamber to said second chamber thereby allowing said hydraulic assembly to act as a snubber for said dipper door when said dipper door is opened and closed, and a valve for controlling hydraulic fluid flow through said restricted flow conduit from one of said chambers to the other of said chambers such that when said valve is closed, the hydraulic fluid is substantially prevented from flowing between said chambers so that said dipper door is substantially prevented from pivoting about said dipper door axis, and such that when said valve is opened, the hydraulic fluid is allowed to flow between said chambers such that said dipper door is allowed to pivot about said dipper door axis.

9. A power shovel according to claim 8, wherein said piston rod is connected to said dipper door.

10. A power shovel according to claim 8, wherein said restricted flow conduit is external of said hydraulic cylinder.

11. A power shovel according to claim 8, wherein said restricted flow conduit extends through said piston.

12. A power shovel according to claim 8, wherein said valve is a solenoid valve.

* * * * *